US005826412A

United States Patent [19]

Harrell et al.

[11] Patent Number: 5,826,412

[45] Date of Patent: Oct. 27, 1998

[54] APPARATUS FOR IMPROVING THE ART OF DALLYING

[76] Inventors: Howard K. Harrell; Wayne A. Payne; Charles B. Mitchell, III, all of 3121 Hartsfield Rd., Tallahassee, Fla. 32303

[21] Appl. No.: 616,220

[22] Filed: Mar. 15, 1996

[51] Int. Cl.[6] ..... A63B 69/00

[52] U.S. Cl. ..... 54/1; 434/247

[58] Field of Search ..... 54/1, 44.1, 44.2, 54/44.7; 434/247

[56] References Cited

U.S. PATENT DOCUMENTS

| | | | |
|---|---|---|---|
| 3,157,976 | 11/1964 | Ellsworth . | |
| 3,529,402 | 9/1970 | Queen | 54/44.7 |
| 3,707,827 | 1/1973 | Strang | 54/44.1 |
| 4,033,097 | 7/1977 | Petit | 54/44.6 |
| 4,268,037 | 5/1981 | McKinley et al. | 434/247 X |
| 4,353,546 | 10/1982 | Rhoades | 434/247 X |
| 4,364,570 | 12/1982 | Hallam | 434/247 X |
| 4,608,811 | 9/1986 | Echeverri | 54/44.2 |
| 4,848,067 | 7/1989 | Martinsen | 54/44.2 |
| 5,192,210 | 3/1993 | Thomas et al. | 434/247 |
| 5,195,306 | 3/1993 | Hadlock | 54/44.7 |

*Primary Examiner*—Robert P. Swiatek
*Attorney, Agent, or Firm*—Carnes, Cona & Dixon

[57] ABSTRACT

An apparatus which is designed to improve the art of dallying. The apparatus is designed and configured to simulate the front end of a conventional saddle. This dallying apparatus comprises a front end connected to a back end via a middle portion. The front end includes the horn which extends upwards from the horn shoulder support, while the back end is secured to the removably secured to the user. This will provide for the horn to be situated in front of the user at the appropriate distance due to the middle portion. Accordingly, once attached, the user can practice and perfect the art of dallying.

20 Claims, 2 Drawing Sheets

APPARATUS FOR IMPROVING THE ART OF DALLYING

BACKGROUND OF THE INVENTION

1. Field of the Invention

The present invention relates generally to an apparatus for improving the art of dallying and more particularly to an apparatus which is adapted to be removably secured to the waist of the user to enable the user to practice and master the art of dallying or wrapping the rope around the saddle horn without the use of a live horse and with the use of an imitation steer.

2. Description of the Prior Art

Rodeo is becoming one of the fastest growing sports today. The excitement, fast pace, and many thrills that are involved make rodeo a great spectator sport as well as a sensational competitor's sport. One of the most fascinating events in rodeo is team roping.

Team roping is an event which involves two team members. The object of this event is to rope a steer in as little time as possible. Each member is on a horse having a saddle which is equipped with a saddle horn. One member ropes the head, removes as much slack as possible within the rope, and then wraps the rope around the saddle horn. The second member ropes the rear legs, removes the slack, and wraps the rope around the saddle horn to provide for the steer to be in a fixed and unmovable position. When the steer has been successfully roped at both ends and the rope has been securely fastened around the saddle horn the time is stopped and recorded. This recorded time is the score and the team with the lowest score is the winner for this event.

In order to become a successful roper, one must perfect several difficult skills and techniques. For example, one must learn how to throw a loop of rope or lasso around an object. Once the object is lassoed, the roper must efficiently wrap his end of the rope around the saddle horn. As the individual masters his skills, timing becomes critical and essential. The roper must not only efficiently accomplish the roping, but the roper must do it in as short of time as possible.

One of the major problems encountered by those who desire to become skillful ropers is obtaining sufficient practice time. A person's roping skills can be perfected to a degree by practicing roping inanimate objects. However, it is virtually impossible to master wrapping the rope around the saddle horn without being mounted on a saddle.

Naturally, it is desirable to obtain as much practice as possible roping from horseback. Though practicing from horseback may be beneficial, it does not enable the roper to concentrate on specific problem areas. Utilizing a live horse does not render a situation which is always convenient and can cause practice to be time consuming and non-beneficial. Accordingly, there is a need for a device which will allow for the roper to practice on throwing and dallying simultaneously and without the use of a live horse.

Previous efforts, as described above, do not provide the benefits intended with the present invention. Additionally, the above described techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides an apparatus which is designed to improve the art of dallying. The apparatus is designed and configured to simulate the front end of a conventional saddle.

This apparatus is compact in size and is adapted to be removably secured to the user. This will render a device which can be utilized whenever desirable.

The apparatus comprises a front end and a back end. Connecting the front end to the back end is a middle portion. The front end of the device is designed and configured to simulate the front seat area of a conventional saddle. Extending upward from the front end or seat area is the saddle horn shoulder support, also known as the tree support. Located on and extending upwardly from the saddle horn shoulder support is the saddle horn. Hence the seat area, saddle horn shoulder support and saddle horn not only constitute the front end of the apparatus, but also simulates a front portion of a conventional saddle.

The back end includes a front surface and a back surface. The back surface is designed to contact the front of a user. This second end acts as a mounting means and includes a securing means attached thereto. The securing means will allow a user to easily and quickly secure or remove the apparatus to or from himself. The mounting means may be padded or include a protection layer for not only providing additional comfort, but also providing a means of protecting the user's skin or belt buckle from irritation or damage.

Accordingly, to utilize the device, the user secures the mounting means to their waist via the securing means. Once secured, the back surface of the back end will be contacting and engaging the front waist of the user to provide for the saddle horn to be located in front of the user. The saddle horn is located in approximately the same location as if the user were mounted on a horse equipped with a saddle. At this point the user may practice throwing the rope around the inanimate object. Once the rope is around the object, the user will pull the rope towards himself. Using the slack in the rope the user will then dally or wrap the rope around the horn. Thereby, the apparatus of the present invention provides a means of practicing and improving the art of dallying.

Hence, it is an object of the present invention to provide an apparatus which will allow the user to practice and perfect necessary skills for becoming an accomplished roper as well as providing a means of becoming proficient at dallying.

Another object of the present invention is to provide for an apparatus which will permit the user to simultaneously toss a rope around an imitation steer and wrap the rope around a saddle horn without the use of a live horse and/or steer.

It is a further object of the present invention to provide for an apparatus and method for perfecting the art of dallying which will overcome the deficiencies, drawbacks and shortcomings of prior apparatus and methods thereof.

Yet another object of the present invention is to provide an apparatus which is compact, easy to transport and carry which will allow the user to practice at any desired location.

Still a further object of the present invention is to provide for an apparatus which will train the user's hands and eyes to stay in sequence with the steer while avoiding downward eye contact or eye contact to the horn, as well as simultaneously building confidence in the user for enabling successful roping of the steer.

Still another object of the present invention is to provide for an apparatus which is not only safe during utilization, but can also be used by any individual regardless of level of skill, size, age, and shape.

It is yet another object of the present invention, to be specifically enumerated herein, to provide an apparatus in accordance with the preceding objects and which will conform to conventional forms of manufacture, be of simple construction and easy to use so as to provide a device that would be economically feasible, long lasting and relatively trouble free in operation.

Although there have been some inventions related to imitation steers, mechanical mounting devices, or saddles, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
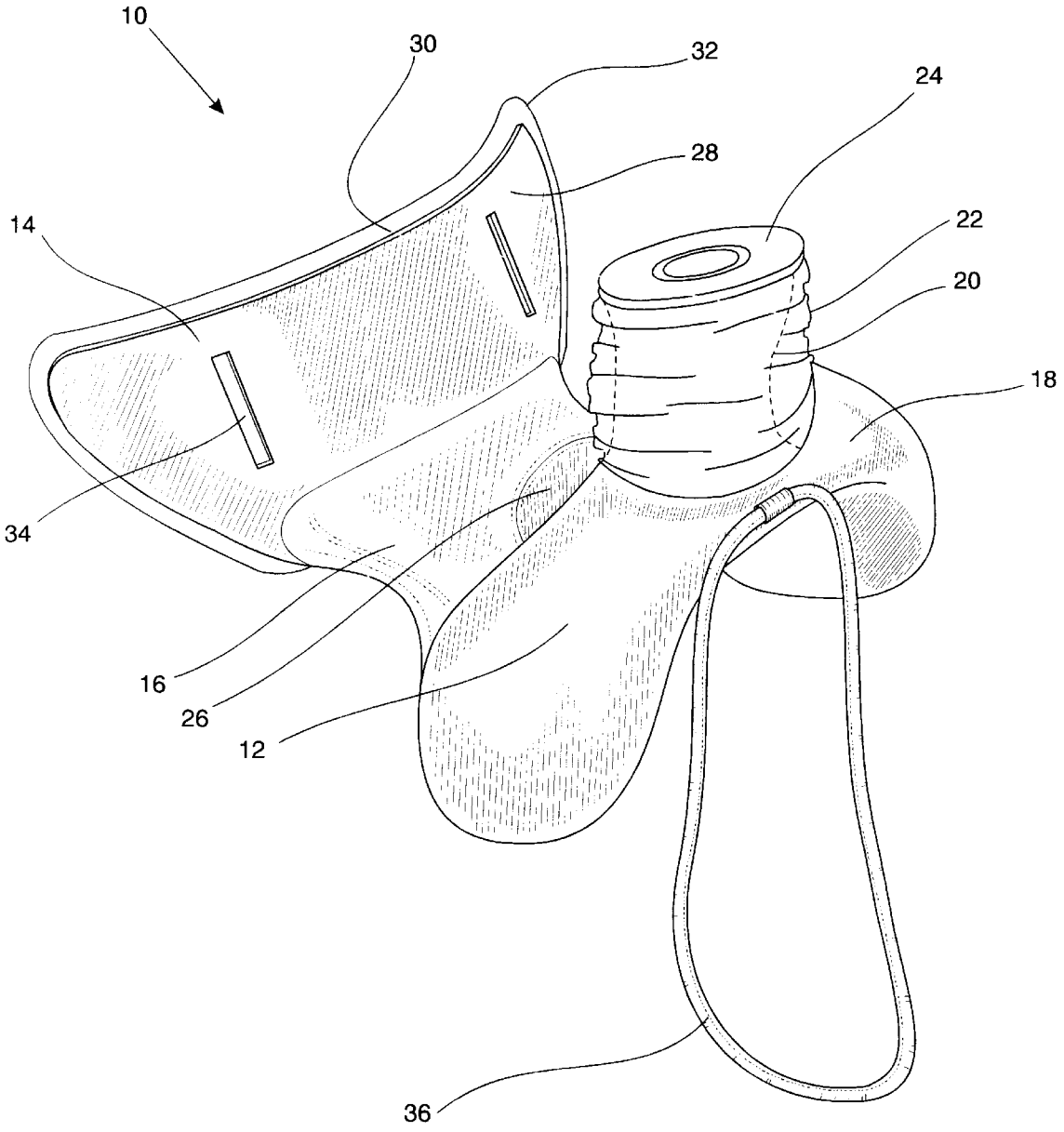
FIG. 1 is a perspective view of the dallying apparatus of the present invention.
Figure 2:
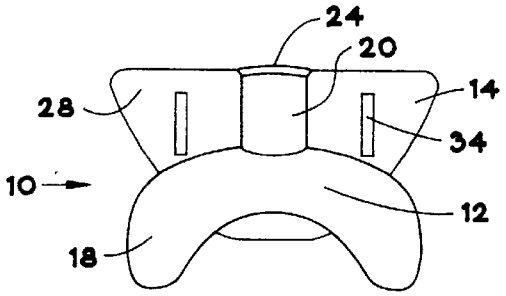
FIG. 2 is a front planar view of the dallying apparatus of the present invention.
Figure 3:
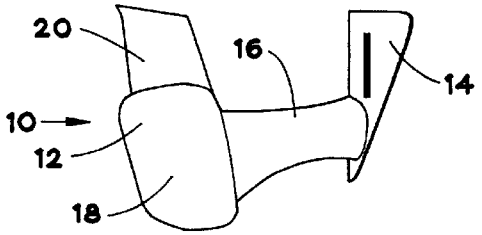
FIG. 3 is a side planar view of the dallying apparatus of the present invention.
Figure 4:
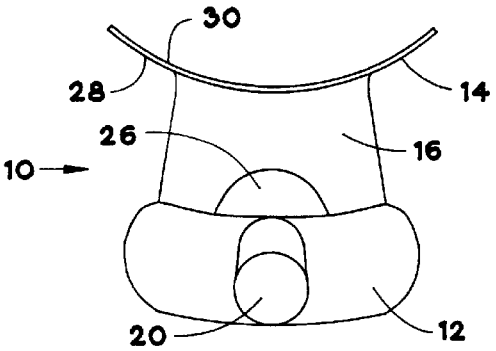
FIG. 4 is a top planar view of the dallying apparatus of the present invention.
Figure 5:
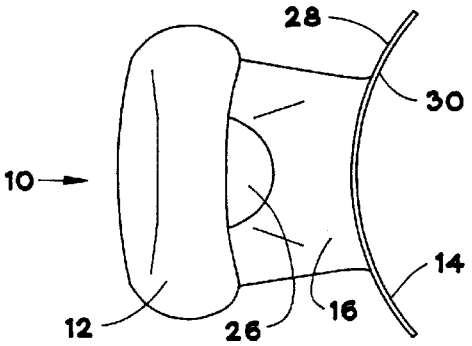
FIG. 5 is a bottom planar view of the dallying apparatus of the present invention.
Figure 6:
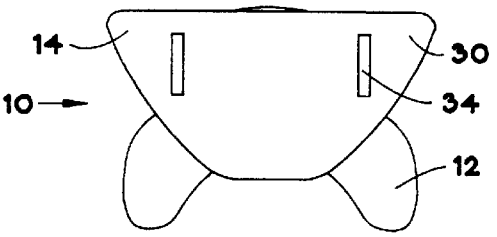
FIG. 6 is a back planar view of the dallying apparatus of the present invention.

Referring to the various views of the drawings, FIGS. 1–6, there is illustrated the preferred embodiment of the dallying apparatus or dally master 10 of the present invention. As seen in the drawings, the dallying apparatus 10 includes a front end 12 and a back end 14. A middle portion 16 secures the front end of the apparatus to the back end of the apparatus.

The front end 12 is curved upwards to provide for saddle horn shoulder supports or tree shoulder supports 18 to extend upwardly from the middle portion 16. Extending upwardly and centrally from the shoulder supports 18 is a horn 20.

The horn includes a first end, which is secured to the top surface of the front end 12, and a second end 24, which is exposed. This second end 24 may be flat, as illustrated, for enabling a logo or the like to be situated and secured thereto.

For providing a better gripping means between the rope and horn 20 during utilization of the device, an anti-skid material 22 (illustrated in FIG. 1), such as rubber or the like, can be secured thereto. This anti-skid material 22 can be placed on the horn 20 in a non-smooth configuration, as illustrated, so as to increase the coefficient of kinetic and static friction. This increase of the coefficient of kinetic and static friction will decrease or possibly eliminate any slippage which may occur between the rope and the horn, to inherently decrease the time required to rope the steer.

This anti-skid material 22 can be any material possessing a high coefficient of friction, such as, but not limited to rubber, polymer, or the like. To provide for a roughened surface, the material may be a strap which is randomly wrapped around the horn (as illustrated in FIG. 1) or optionally the material may be incorporated with ridges, extension, bumps or the like to provide for the material to be an integral structure having a roughened or non-smooth surface.

To provide for a more realistic saddle and a more realistic environment during practice, the dallying apparatus 10 may also include a strap or reins 36 secured at any location to the front end 12. These reins 36 can be either permanently secured thereto or adapted to be removably secured thereto for enabling easy manufacturing of the apparatus.

The use of the reins 36 will aid in improving the art of dallying. When practicing without a live horse, an individual will have the tendency of dropping their hand after the rope is thrown. In reality, the hand must be located in front of the rider for enabling the rider to hold the reins, so as to control the horse during competition. The use of the reins 36 in this apparatus will inherently force the user to maintain their hands in an upright and frontward position. Thereby, the reins 36 in the disclosed apparatus will simulate reins used when utilizing a live horse.

The middle portion 16 connects the front end 12 to the back end 14 of the device and acts as an attaching means. The middle portion 16 can include an aperture 26. This aperture can be used for carrying the apparatus 10 of the present invention or optionally, this aperture can also be used for receiving a nail, hook, or the like, to enable the device to be in a hung, upright, and stored position.

The combination of the front end 12 and middle portion 16 provides for an apparatus which simulates the front portion of a conventional saddle. Thereby, rendering an apparatus which will provide a realistic portrayal of a saddle to allow users to practice and perfect the roping without utilizing live animals, such as horses and steers.

The back end 14 of the device is adapted to be removably secured to the user. As such, this back end 14 includes a curved configuration so as to provide for a comfortable fit between the apparatus 10 and user. This back end 14 acts as a mounting means and comprises a front surface 28 and a back surface 30. The front surface 28 is affixed to the middle portion 16 while the back surface 30 engages the user.

The front surface is affixed to the middle portion 16 to provide for the middle portion 16 to extend outwardly from the back end 14. Secured to the mounting means or back end 14 is a securing means. This securing means will allow for the apparatus 10 to be removably secured to the user. As such, this securing means can include a pair of slits or openings 34 to extend through the back end 14 of the apparatus 10. These slits 34 are oppositely located and are situated in proximity to the edge of the back end 14.

The slits are designed and configured to receive and maintain a conventional strap, belt or the like, so as to provide for the apparatus 10 to be removably secured to the user.

Optionally, the back surface 30 of the back end 14 can be equipped with mounting points so as to provide for straps to be secured to the back surface either removably, such as the use of screws, rivets or the like, or permanently. This will provide for straps to be secured to the device and will eliminate the need for the user to insert a conventional belt or the like into the slits 34.

The back surface 30 of the back portion 14 of the device 10 can include a protective layer 32 (see FIG. 1). The protection layer will provide additional comfort for the user as well as providing a means of protecting the user's skin or belt buckle from irritation or damage.

This protection layer can be fabricated from any durable, non-toxic insulating material, such as, but not limited to, rubber, felt, sheep wool, or the like. It is noted that sheep wool has been utilized and has produced favorable results. The use of the sheep wool not only offers adequate protection, but also enables the user to identify with a conventional saddle, since such a material is typically used in the under surface of a conventional saddle.

The front end, back end, and middle portion of the apparatus is formed as an integral structure. It is fabricated from a durable, light weight material, such as high density polyethylene and can be molded into a single unit. This will provide for the reins and anti-skid material to be secured onto the apparatus after the formation of the front end, back end, and middle portion.

Accordingly, to utilize the device, the user secures the mounting means to their waist via the securing means. Once secured, the back surface of the back end will be contacting and engaging the front waist of the user to provide for the saddle horn to be located in front of the user. If the protection layer is used, then the protection layer is contacting the user.

The saddle horn is located in approximately the same location as if the user where mounted on a horse equipped with a saddle. If the apparatus is equipped with reins, the user grasp the reins. At this point the user may practice throwing the rope around the inanimate object. Once the rope is around the object, the user will pull the rope towards himself. Using the slack in the rope, the user will then dally or wrap the rope around the horn. Thereby, the apparatus of the present invention provides a means of practicing and improving the art of dallying.

While the invention has been particularly shown and described with reference to an embodiment thereof, it will be understood by those skilled in the art that various changes in form and detail may be made without departing from the spirit and scope of the invention.

We claim:

1. A dallying apparatus comprising:

a front end having a horn;

a back end;

a middle portion is located between said front end and said back end;

said back end includes a securing means for enabling removable attachment to a user;

said middle portion secures said back end to said front end and said back end extends upwardly and substantially transversally and vertically from a longitudinal axis to provide for said middle portion to be substantially perpendicular from said middle portion and said back end is inwardly convex with respect to said middle portion for providing for said back end to conform to the shape of said user;

said convex back end and said horn are anteiorly located when said securing means is attached to said user, and said horn and said back end are in an upright position and both extend upwardly from said middle portion;

said back end, said middle portion, said front end and said horn form an integral and rigid structure, and said middle portion is displaced lower than said horn for providing a structure which is suited for dallying.

2. A dallying apparatus as in claim 1 wherein said horn is coated with an anti-skid material.

3. A dallying apparatus as in claim 2 wherein said anti-skid material is roughened.

4. A dallying apparatus as in claim 2 wherein said anti-skid material is a strap wrapped around said horn and said strap possesses a high coefficient of friction.

5. A dallying apparatus as in claim 2 wherein a strap is secured to said front end for simulating reins.

6. A dallying apparatus as in claim 5 wherein said front end includes shoulder supports which curve upwards and said horn is centrally affixed and extends upwardly from said shoulder supports.

7. A dallying apparatus as in claim 6 wherein said back end includes a front surface and a back surface, said front surface is affixed to said middle portion, said back surface includes a protective layer.

8. A dallying apparatus as in claim 7 wherein said protective layer is selected from the group consisting of rubber, felts or sheep wool.

9. A dallying apparatus as in claim 8 wherein said back end is curved to conform to a waist of said user.

10. A dallying apparatus as in claim 9 wherein said middle portion includes an aperture.

11. A dallying apparatus as in claim 10 wherein said securing means comprises slits extending through said back end for receiving a conventional strap or belt.

12. A dallying apparatus as in claim 8 wherein said integral and rigid structure is fabricated of a high density polyethylene.

13. A dallying apparatus as in claim 1 wherein said horn includes a first end secured to a top surface of said front end and a second end, said second end is flat and includes a logo or design.

14. A dallying apparatus as in claim 1 wherein a strap is secured to said front end for simulating reins.

15. A dallying apparatus as in claim 1 wherein said middle portion includes an aperture.

16. A dallying apparatus as in claim 1 wherein said front end includes shoulder supports which curve upwards and said horn is centrally affixed and extends upwardly from said shoulder supports.

17. A dallying apparatus as in claim 1 wherein said back end is curved to conform to a waist of said user.

18. A dallying apparatus as in claim 1 wherein said securing means comprises slits extending through said back end for receiving a conventional strap or belt.

19. A dallying apparatus as in claim 1 wherein said back end includes a front surface and a back surface, said front surface is affixed to said middle portion, said back surface includes a protective layer.

20. A dallying apparatus as in claim 1 wherein said integral and rigid structure is fabricated of a high density polyethylene.

* * * * *